United States Patent [19]

Mintz

[11] Patent Number: 4,687,238

[45] Date of Patent: Aug. 18, 1987

[54] GATE LOCK

[76] Inventor: Daniel Mintz, 70 Cambridge Pl., Brooklyn, N.Y. 11238

[21] Appl. No.: 874,418

[22] Filed: Jun. 16, 1986

[51] Int. Cl.[4] ..... E05C 5/02

[52] U.S. Cl. ..... 292/137; 292/149; 292/302; 292/189

[58] Field of Search ..... 292/137, 145, 149, 183, 292/189, 302

[56] References Cited

U.S. PATENT DOCUMENTS

| | | | |
|---|---|---|---|
| 389,704 | 9/1888 | Holland | 292/149 |
| 988,455 | 4/1911 | Gee | 292/189 |
| 1,456,611 | 5/1923 | Fritts | 292/189 |
| 1,646,136 | 10/1927 | Booth | 292/145 |
| 2,176,428 | 8/1938 | Tveden | 292/149 |
| 2,723,147 | 11/1955 | Slaughter | 292/302 |
| 2,767,494 | 10/1956 | Peterson | 292/149 |
| 3,663,989 | 5/1972 | Ellaro | 292/302 |
| 4,013,311 | 3/1977 | Prezioso | 292/302 |

FOREIGN PATENT DOCUMENTS

| | | | |
|---|---|---|---|
| 1152127 | 8/1983 | Canada | 292/149 |
| 40378 | 6/1929 | Denmark | 292/189 |
| 951858 | 10/1956 | Fed. Rep. of Germany | 292/149 |
| 21913 | 2/1947 | Finland | 292/302 |
| 40751 | 4/1902 | France | 292/302 |

*Primary Examiner*—Cornelius J. Husar
*Assistant Examiner*—Eric K. Nicholson
*Attorney, Agent, or Firm*—Steele, Gould & Fried

[57] ABSTRACT

A gate lock is disclosed for use with swinging gates of the chain link type which includes upper and lower hollow cylindrical housings respectively affixed to adjacent vertical elements of swinging gates. A sliding bolt is in vertical sliding and rotatable arrangement within the bore of the upper housing and is movable between an upper, unlocked position and a lower locked position wherein the bottom of the bolt enters the bore of the lower housing. The lower housing includes a plurality of vertically spaced, key positioning plates which are arranged to require insertion and removal of an operating key in angularly offset relationship from the housing axis. The key positioning plates are further designed to axially align the key after insertion whereby the key head can engage a shaped recess in a threaded locking bolt to threadedly engage and lock the sliding bolt of the upper housing within the lower housing.

14 Claims, 10 Drawing Figures

GATE LOCK

BACKGROUND OF THE INVENTION

1. Field of the Invention

The present invention relates generally to the field of locking devices, and more particularly, is directed to a rugged gate lock construction that is not subject to attack by readily available chain and bolt cutters, hacksaws and the like.

2. Discussion of the Prior Art

Locking devices of many various designs, sizes, materials and types have long been known for securing doors, gates, grilles and other closures. Locking devices have been available substantially as long as man has experienced a need or a want to protect his possessions from access by others. When locking hingedly connected gates of the type normally associated with vehicle or equipment containing yards, it has been the common practice in the past to employ chain line type gates with hasps or eye constructions and to insert a padlock through mating openings in two adjacent swinging gates or between cooperating locking openings provided in a single gate and in a fixed jamb. Alternately, it has also been the common practice to utilize a sturdy chain wrapped about adjacent movable gate members and to apply a padlock through spaced links on the chain in order to lock such gates.

All of the prior art locking devices of which I am aware are relatively easily destroyed by a determined intruder simply by employing common, readily available metal cutting tools, such as a bolt cutter or a hacksaw. Such hacksaws and bolt cutters, when properly employed, could rather easily and quickly either cut through the links of the chain or through the U-shaped portion of the padlock. Once the lock was destroyed, the intruder was then free to enter the premises through the previously locked gate.

In the currently popular types of outdoor installations, such as common chain link gate constructions, there is no known locking apparatus that is currently available which may be mounted in a recessed manner to defeat attack by a bolt cutting instrument. Accordingly, the need remains to provide an, inexpensive and sturdy chain link gate lock of rugged construction that is reliable for usual gate locking purposes and which is inherently designed to resist attach by metal cutting tools.

SUMMARY OF THE INVENTION

The present invention relates generally to the field of locking devices for gates, and more particularly, is directed to a novel chain link type gate locking device having rugged components that are not susceptible to severing when utilizing bolt cutters or hacksaws.

The lock of the present invention includes a pair of cooperating, cylindrical, axially juxtaposed housings which may be either horizontally or vertically aligned, depending upon the gate construction to be locked.

A sliding bolt which may be fabricated of common iron pipe is a sliding fit within one of the housings and is positioned to be moved into and out of locking engagement with the second of the said housings. The interior of the sliding bolt is provided with a threaded locking plate to threadedly receive therein the threaded end of a locking member which is concentrically positioned within the opposed housing. A plurality of axially spaced key positioning plates are welded or otherwise secured within the housing containing the threaded locking member to permit the conscious maneuvering of a special key to enable the key to engage and turn the threaded locking member for gate locking purposes. By requiring a special, shaped key and particular knowledge of operation of the lock, many would-be trespassers will initially be thwarted, all without any damage to the installation.

Preferably, the spaced key positioning plates comprise an inner positioning plate and inner and outer key insertion plates having shaped key receiving openings therein. The key receiving openings are positioned in one hundred and eighty degree offset relationship from each other and are specially shaped to admit the larger shaped head of a special L-shaped key. The key receiving openings respectively terminate inwardly in radially aligned slots to thereby permit the key undercut shank to be axially aligned with the axis of the housing when properly manipulated. When the shaped key head has been manipulated to be axially aligned, the key can then be axially inserted through the central opening in the inner positioning plate to engage the head of the threaded locking member to thereby threadedly urge the locking member into engagement with the threaded opening provided in the sliding bolt locking plate. When the threaded lock member is threadedly engaged within the sliding bolt locking plate, the locking extension of the sliding bolt will be pulled and positioned within the bore of the opposed housing, thereby providing a sturdy, protected and extremely serviceable gate locking arrangement. It is noteworthy that the threaded lock member will be completely shielded and protected by the sliding bolt construction when the parts are in the locked position.

It is therefore an object of the present invention to provide an improved gate lock of the type set forth.

It is another object of the present invention to provide a novel gate lock comprising a pair of rugged, opposed housings, a sliding bolt slidingly retained within one of the housings, a unique key aligning plate assembly secured within the other of the said housings, a threaded lock member secured in the said other housing and extending toward the sliding bolt and key means to turn the threaded locking member to threadedly engage the sliding bolt to thereby lock the first and second housings in a manner not subject to attack by commonly employed lock destroying tools.

It is another object of the present invention to provide a novel gate lock comprising a first housing having an axially sliding bolt retained therein, a second housing having a plurality of key positioning plates secured therein, the second housing securing a threaded lock member axially therein and a special key adapted to be manipulated through the key positioning plates to turn the threaded lock member into threaded engagement with the sliding bolt to thereby internally secure the operating parts together in a rugged, tamper resistant construction.

It is another object of the present invention to provide a novel gate lock comprising first and second housing means in axially aligned, juxtaposed relationship, sliding bolt means slidingly retained within the first housing means, key positioning means secured within the second housing means, threaded sliding bolt engagement means retained within the second housing means and special key means insertable through the key positioning means to turn the threaded sliding bolt engagement means into engagement with the sliding bolt means to secure the first and second housing means together in a tamperproof manner.

It is another object of the present invention to provide a novel gate lock that is rugged in construction, inexpensive in manufacture and trouble free when in use.

Other objects and a fuller understanding of the invention will be had by referring to the following description and claims of a preferred embodiment thereof, taken in conjunction with the accompanying drawings, wherein like reference characters refer to similar parts throughout the several views and in which:

DESCRIPTION OF THE PREFERRED EMBODIMENT OF THE INVENTION

Figure 1:
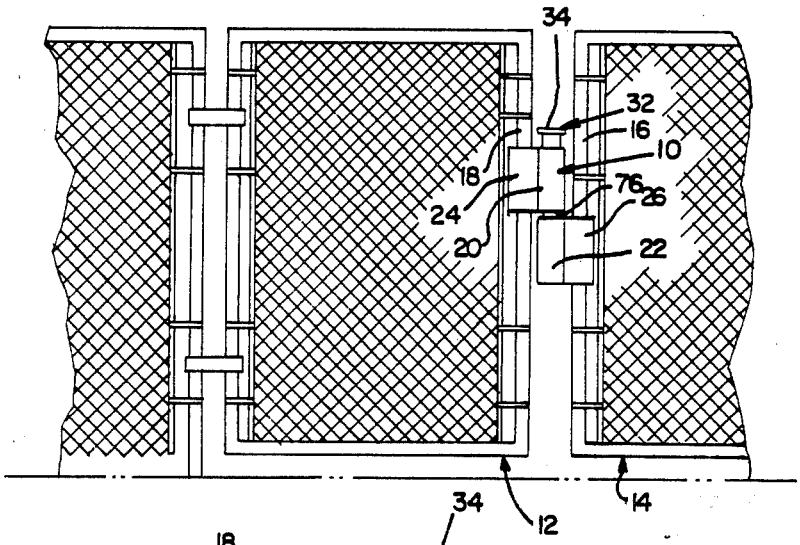
FIG. 1 is an elevational view showing the gate lock of the present invention installed on a chain link gate in a vertical orientation.

Although specific terms are used in the following description for the sake of clarity, these terms are intended to refer only to the particular structure of the invention selected for illustration in the drawings, and are not intended to define or limit the scope of the invention.

Referring now to FIG. 1, the gate lock 10 of the present invention is illustrated installed on a double, horizontal, hinged chain link gate construction 12, 14 on the respective mating vertical rails 16, 18 thereof. A hollow, cylindrical upper housing 20 is permanently secured to the vertical gate rail 18 through an upper housing connector 24 which is welded both to the mating rail 18 and to the upper housing 20 in known manner to provide a firm, permanently attached construction. Similarly, a hollow cylindrical lower housing 22 is permanently affixed to the mating rail 16 through a lower housing connector 26 which also is securely welded to provide a permanent interconnection. The upper and lower housings, 20, 22, when properly installed, are in vertical registry with each other and define a small clearance space 76 therebetween to permit the usual swinging operation of the gates 12, 14 when in the unlocked condition.

Figure 2:
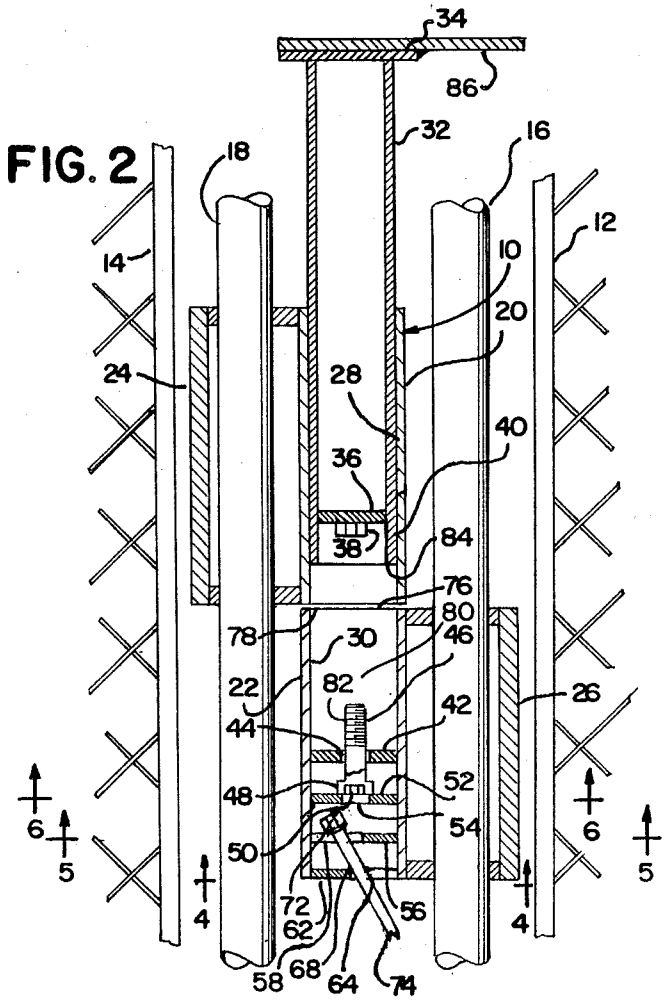
FIG. 2 is an enlarged, sectional view of the gate lock of FIG. 1 showing the internal operating components of the gate lock in unlocked condition and with the lock member head partially broken away.

Preferably, the upper and lower housings 20, 22 are fabricated of inexpensive, rugged material, for example, schedule 40 galvanized pipe. A sliding bolt 32 is in sliding contact within the bore 28 of the upper housing 20 and is also fabricated of rugged, readily available material, such as schedule 40 galvanized pipe. In a preferred embodiment, the upper housing 20 is fabricated of three inch OD schedule 40, galvanized pipe and the sliding bolt 32 is fabricated of two and one-half inch OD schedule 40 galvanized pipe. As best shown in FIG. 2, a locking plate 36 is welded or otherwise secured interiorly of the sliding bolt 32 and is axially provided with a five-eights inch threaded nut 38 to lockingly receive the threaded shank 82 of the lock member 46 in a manner hereinafter more fully set forth. As shown, the locking plate 36 is axially upwardly positioned from the bottom end of the bolt 32 and defines a lower locking extension 40 for gate locking purposes.

Figure 3:
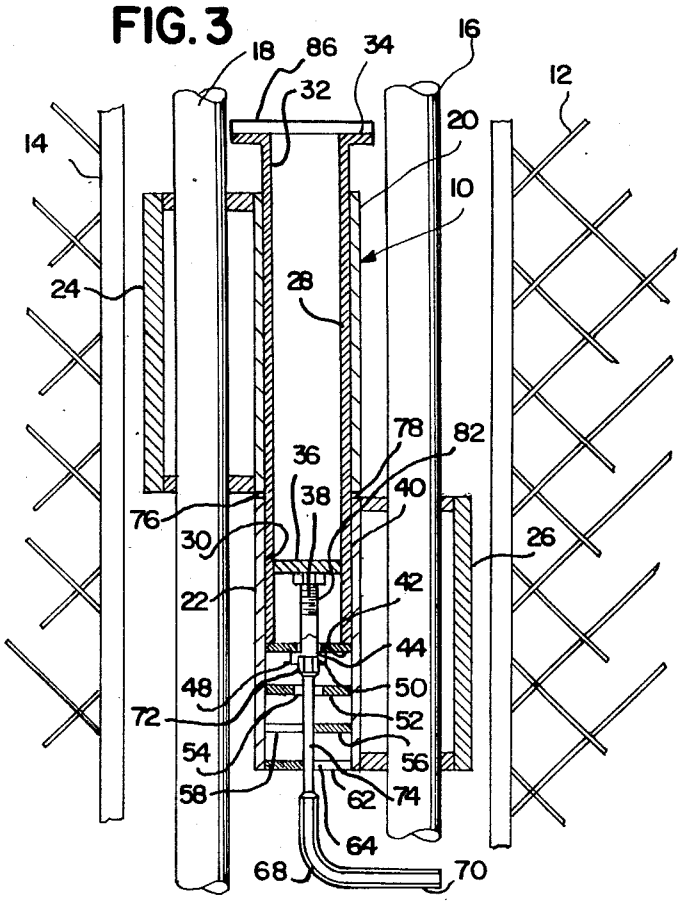
FIG. 3 is a cross sectional view similar to FIG. 2 showing the components of the gate lock in locked condition and with the lock member head partially broken away to disclose details of the keyed opening.

Referring to FIGS. 2 and 3, the lower housing 22 includes the key positioning means comprising the inner positioning plate 52, the first key plate 56 and the second key plate 62, which plates are securely welded in position within the bore 30 of the lower housing 22. Preferably, the second key plate 62 is affixed at the lower end of the lower housing 22 and the other plates 56, 52 are interiorly positioned at approximately one inch intervals. A bolt plate 42 is interiorly welded within the bore 30 of the lower housing 22 in spaced relationship below the top 78 of the lower housing 22 and above the inner key positioning plate 52. The bolt plate 42 defines an upper cavity 80 in the upper position of the bore 30 to receive therein in locking engagement the locking extension 40 of the sliding bolt 32 for gate locking purposes.

Figure 4:
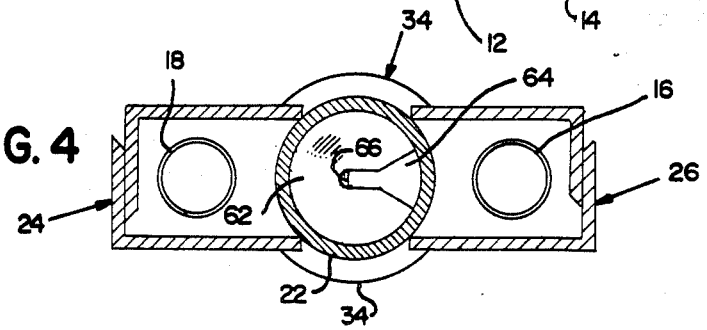
FIG. 4 is a cross sectional view taken along line 4—4 on FIG. 2, looking in the direction of the arrows.
Figure 5:
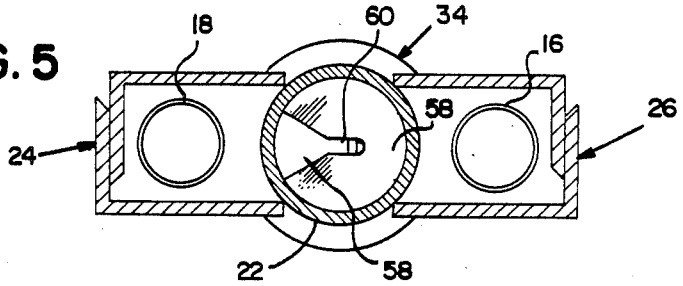
FIG. 5 is a cross sectional view taken along line 5—5 on FIG. 2, looking in the direction of the arrows.
Figure 6:
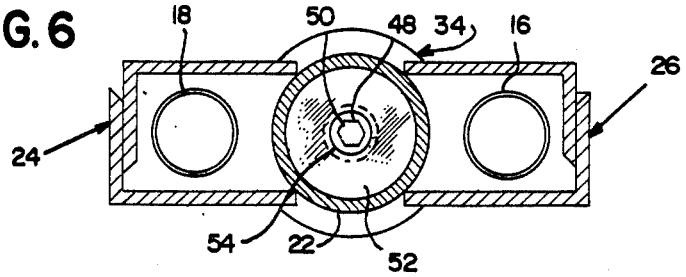
FIG. 6 is a cross sectional view taken along line 6—6 on FIG. 2, looking in the direction of the arrows.

As best seen in FIGS. 2, 4 and 5, the first and second key plates 56, 62 are similarly formed and are positioned in one hundred and eighty degree offset relationship. Each plate 56, 62 comprises a peripheral, enlarged, key receiving opening 58, 64, which openings are illustrated as preferably being generally wedge-shaped in configuration. However, it will be appreciated that other key receiving opening configurations to receive the key 68 for gate locking and unlocking purposes may also be employed with equal facility. Each of the openings 58, 64 terminates radially inwardly in a respective radial slot 60, 66, which slots extend radially inwardly past the central axis of the lower housing 22. The inner positioning plate 52 is provided with a concentric opening 54 of suitable diameter to receive therethrough the shaped head 72 of the key 68 in the manner hereinafter more fully set forth. See FIGS. 3 and 6.

Still referring to FIGS. 2 and 3, the bolt plate 42 is drilled or otherwise worked to provide a concentric opening 44 which is unthreaded and of size to slidingly receive therethrough the threaded lock member 46. The lock member 46 comprises a threaded shank 82 and an inwardly or downwardly positioned head 48. In the illustrated embodiment, the head 48 faces downwardly or in a direction facing away from the upper housing 20. The lock member head 48 is machined or otherwise treated as necessary to provide a shaped, key receiving opening 50 to receive therein a specifically shaped key, for example a hex-shaped key 68. While a hexagonal cross sectional configuration is illustrated, it will be appreciated that other socket configurations may be formed in the head in known manner if so desired. In such a situation, a similarly shaped, cooperating key head would have to be provided. The threaded lock member 46 is axially aligned within the unthreaded opening 44 and is long enough to extend from the bolt plate 42 to engage the threaded nut 38 provided in the locking plate 36 in the upper housing 20 when the parts are locked together. If desired, a stabilizing handle 86 can be welded or otherwise secured to the end of the sliding bolt 32 to facilitate operation.

Referring now to FIG. 3, the gate lock key 68 is illustrated and comprises generally an L-shaped handle 70, a relatively short, hexagonally shaped key head 72 and an elongated, undercut medial section 74. In the illustrated configuration, the key may be conveniently formed of one-half inch hexagonal steel rod which may be machined throughout the undercut medial section 74 down to approximately three-eights inch diameter. The undercut medial section 74 is sized to conveniently radially slide within the respective radial slots 60, 66 which are provided in the first and second key plates 56, 62.

In order to use the gate lock of the present invention, the parts are fabricated and positioned on the gates 12, 14 in the manner illustrated in FIG. 1. With the threaded lock member 46 disengaged from the threaded opening 38 within the locking plate 36, the sliding bolt 32 may be grasped at its enlarged head 34 and pulled upwardly through the upper housing 20 until the bottom terminus 84 is pulled above the top terminus 78 of the lower housing 22 to define the clearance space 76. See FIG. 2. With the parts thus positioned, the gates 12, 14 will be unlocked and completely free to swing relative to one another.

When it is desired to lock the gates 12, 14, the sliding bolt 32 is downwardly urged relative to the upper housing 20 by pressure upon the bolt head 34 to close the clearance space 76. In the locking position, the sliding bolt locking extension 40 will enter the upper portion of the lower housing bore 30 to prevent movement of either gate 12, 14 relative to the other. The bolt 32 will downwardly slide within the upper housing 20 until either the bolt head 34 contacts the top of the upper housing 20 or the bottom terminus 84 of the sliding bolt contacts the lower housing bolt plate 42. With the parts so positioned, the key 68 can then be employed for locking purposes.

As illustrated in FIGS. 2 and 3, in order to lock the upper and lower components of the gate lock 10 together, the shaped key head 72 is bottomly applied to the lower housing 22 in angular alignment to the axis of the housing by inserting the key head 72 through the offset enlarged key receiving openings 64, 58 which are formed in the vertically spaced second and first key plates. Once the key head 72 has been manipulated past the upper enlarged opening 58, then the key may be axially aligned within the lower housing 22 by urging the undercut medial section 74 of the key 68 radially oppositely inwardly along the spaced slots 66 and 60 until the key medial section 74 is axially aligned within the lower housing 22. With the key medial section axially aligned, upward urging of the handle 70 will cause the key head 72 to pass through the axially aligned inner positioning plate concentric opening 54 and then into engagement within the shaped key opening 50 provided in the lock member head 48. Once the key head 72 is properly seated and engaged within the key opening 50, the key handle 70 may be rotated below the bottom of the lower housing 22 in usual manner to threadedly engage the locking member shank 82 within the threaded nut 38 of the upper housing locking plate 36. The threaded lock member 46 should be turned sufficiently to prevent disengagement of the parts and thus lock the gates 12, 14 in their closed position. See FIG. 3. Once the gates are locked, the key 68 can then be downwardly removed by reversing the key insertion steps above described.

It is noteworthy that when the sliding bolt 32 is secured to the lower housing 22 by the threaded lock member 46, the clearance space 76 between the upper and lower housings 20, 22 will be traversed by the locking extension 40 and the threaded lock member will be completely shielded by the bolt 32 and thus not exposed to attack by a usual bolt or chain cutter. Additionally, it is noteworhy that the sliding bolt 32 will still be rotatable within the upper housing 20 and accordingly, will discourage severing by a hacksaw or other similar device.

Figure 7:
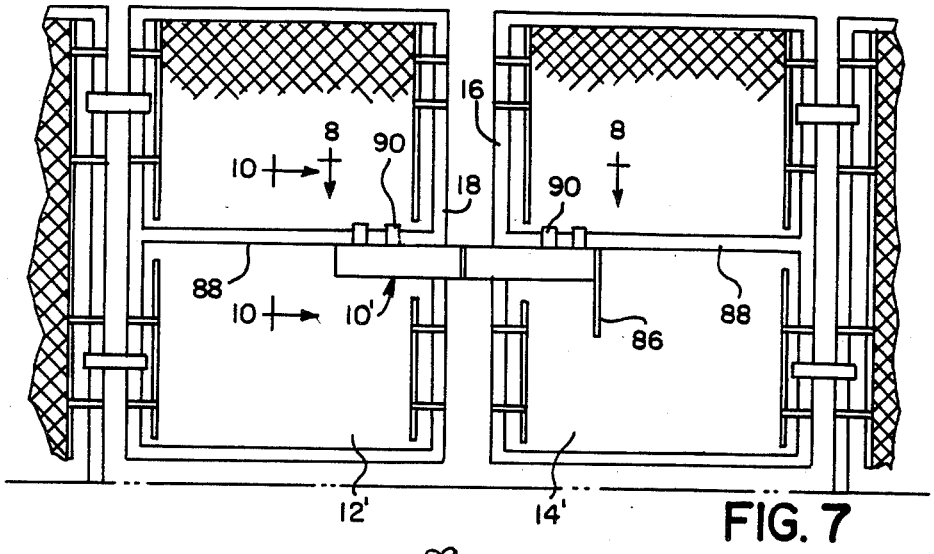
FIG. 7 is an elevational view showing the gate lock of the present invention installed on a chain link gate in a horizontal orientation.
Figure 10:
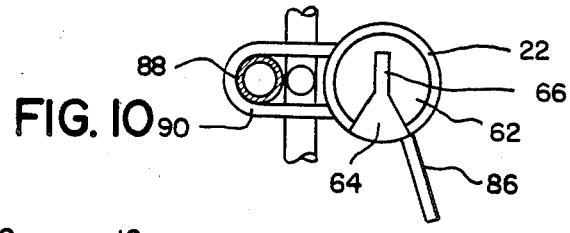
FIG. 10 is an end elevational view looking from line 10—10 in FIG. 7 in the direction of the arrows.
Figure 8:
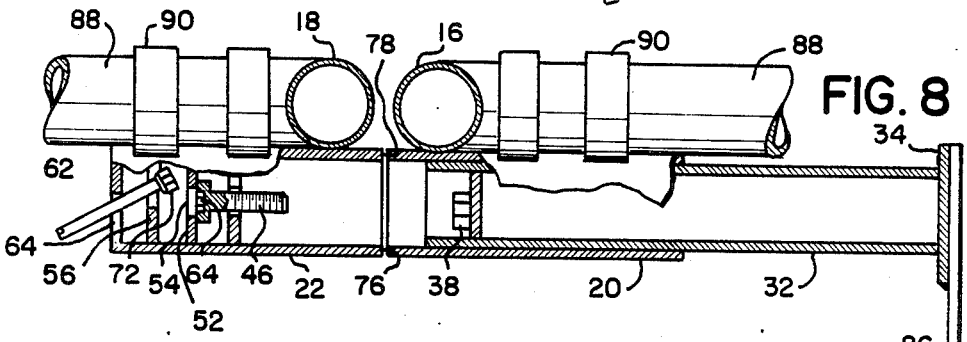
FIG. 8 is an enlarged partial top plan view looking from line 8—8 in FIG. 7 and partially broken away to expose interior operating details.
Figure 9:
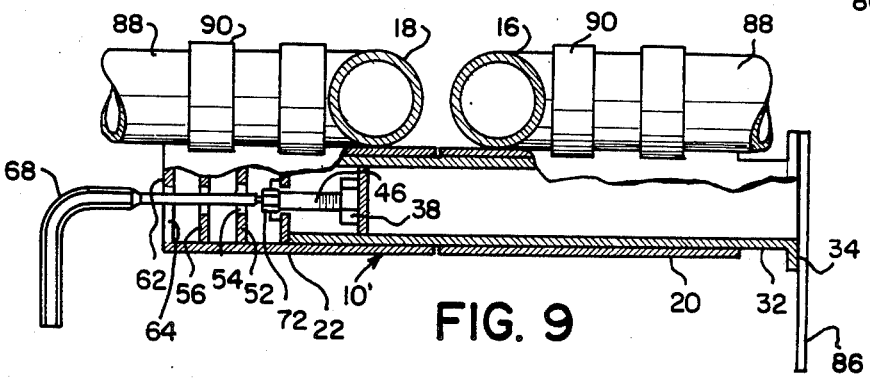
FIG. 9 is an enlarged, partial top plan view similar to FIG. 8, showing the operating parts in locked arrangement.

Referring now to FIGS. 7, 8 and 9, a modified gate lock 10' is illustrated in horizontal arrangement. The lock is secured to a middle horizontal rail 88 which is conventionally provided in horizontally swinging type gates 12', 14'. The horizontal lock 10' is constructed similarly to the vertical lock 10 and is arranged to function in similar manner. As shown, the lock 10' can be affixed to the horizontal gate rails 88 in a known, secure manner, for example, by employing a plurality of weld straps 90. The horizontal lock 10' can be operated in a manner similarly to the operation of the lock 10 except that the sliding bolt 32 will herein be urged horizontally and the key 68 will be horizontally applied through the various key plates 52, 56, 62, rather than vertically as disclosed in the first embodiment.

Although the present invention has been described with reference to the particular embodiments herein set forth, it is understood that the present disclosure has been made only by way of example and that numerous changes in the details of the construction may be resorted to without departing from the spirit and scope of the invention. Thus, the scope of the invention should not be limited by the foregoing specification, but rather, only by the scope of the claims appended hereto.

What is claimed is:

1. A gate lock for securing one or more movable gates comprising a first housing secured to a first gate and a second housing secured in juxtaposed relationship to the first housing and adapted to be releasably locked to the first housing, the first and second housings defining a clearance space therebetween, the first and second housings having longitudinal bores;

a locking bolt in sliding relationship within the bore of the first housing, the bolt being of sufficient length to traverse the clearance space and enter the bore of the second housing, the locking bolt having a first unlocked position within the bore of the first housing and a second, locked position wherein a portion of the locking bolt is positioned within the bore of the second housing;

a key positioning means secured within the bore of the second housing to selectively receive and axially align an operating key, the operating key comprising a handle and a key head secured to the handle, the key positioning means comprising an inner positioning plate, the inner positioning plate having an axially aligned opening therethrough, the opening receiving an axially aligning the said key head; and a threaded lock member positioned within the bore of the second housing in spaced relationship to the key positioning means, the lock member being of sufficient length to contact the locking bolt, the threaded lock member comprising a head having a shaped key receiving recess therein;

wherein the key head of the operating key is insertable through the key positioning means axially aligned opening to engage the key receiving recess in the threaded lock member to turn the threaded lock member to threadedly engage the locking bolt.

2. The gate lock of claim 1 wherein the key positioning means comprises a first key plate in axially spaced relationship to the inner positioning plate, the first key plate being provided with first shaped opening.

3. The gate lock of claim 2 wherein the first shaped opening comprises a first, thin, radially extending slot, the first slot being of suitable width to receive therein the undercut medial section of the key.

4. The gate lock of claim 3 wherein the first shaped opening further comprises a first, enlarged, key receiving portion, the first key receiving portion being in communication with the first slot.

5. The gate lock of claim 4 wherein the first key receiving portion is generally wedge-shaped in configuration.

6. The gate lock of claim 4 wherein the key positioning means comprises a second key plate in axially spaced relationship to the first key plate, the second key plate being provided with a second shaped opening.

7. The gate lock of claim 6 wherein the second shaped opening comprises a second, thin, radially extending slot, the second slot being of suitable width to receive therein the undercut medial section of the key.

8. The gate lock of claim 7 wherein the second shaped opening further comprises a second, enlarged, key receiving portion, the second key receiving portion being in communication with the said second slot.

9. The gate lock of claim 8 wherein the second key receiving portion is generally wedge-shaped in configuration.

10. The gate lock of claim 8 wherein portions of both the first and second slots are in axial alignment.

11. The gate lock of claim 8 wherein the first shaped opening is positioned in angularly offset relationship to the second shaped opening.

12. The gate lock of claim 11 wherein the angular offset between the first and second shaped openings is approximately one hundred and eighty degrees.

13. The gate lock of claim 1 and a locking plate secured within the locking bolt, the locking plate being provided with a threaded opening therein.

14. The gate lock of claim 13 wherein the threaded opening is axially aligned and is adapted to threadedly receive the threaded lock member therein.

* * * * *